United States Patent [19]

De Maria

[11] 4,000,529

[45] Jan. 4, 1977

[54] RECLINING CHAIR

[76] Inventor: Carmine De Maria, 39 E. Madison Ave., Collingswood, N.J. 08908

[22] Filed: Sept. 2, 1975

[21] Appl. No.: 609,737

[52] U.S. Cl. ..... 5/37 R; 5/13

[51] Int. Cl.[2] ..... A47C 17/14

[58] Field of Search ..... 5/13, 30, 37 R, 44, 5/48, 55, 66; 297/64, 84, 88, 107, 318

[56] References Cited

UNITED STATES PATENTS

| | | | |
|---|---|---|---|
| 426,026 | 4/1890 | Langhorne | 5/14 |
| 1,200,542 | 10/1916 | Thibault | 297/108 |
| 1,213,380 | 1/1917 | Karpen | 5/14 |
| 3,880,462 | 4/1975 | Mednick | 297/84 |

*Primary Examiner*—Casmir A. Nunberg
*Attorney, Agent, or Firm*—Clarence A. O'Brien; Harvey B. Jacobson

[57] ABSTRACT

A seat construction including a main frame having front and rear portions is provided together with a first seat section overlying the frame, a second back rest section projecting upwardly from the rear of said frame and a third leg rest section depending downwardly from the forward portion of the first section. The first section is supported from the frame for shifting to a forward position projecting forwardly of the main frame, the second back rest section has its lower portion pivotally supported from the first section and enjoys a supportive link connection with the frame for automatic movement to a lowered horizontal position disposed immediately to the rear of and in horizontal alignment with the first section upon its movement to its forward displaced position, and the third leg rest section has its upper portion pivotally supported from the forward end of the first section and enjoys a thrust transmitting connection with the second section for automatic movement of the leg rest section to a second raised horizontal position horizontally aligned with the first section upon movement of the first and second sections to their second positions. Furthermore, the first section and frame include coacting structure guidingly and supportingly engaging the first section from the forward portion of the frame during shifting movement of the first seat section and operative to slightly lower the forward portion of the seat section upon movement of the first section to its forward position, the forward portion of the seat section including depending legs for engagement with the support surface upon which the frame rests when the first section is in its forward position.

7 Claims, 7 Drawing Figures

120
122
130
20
126
128
100
124
114
116
14
6
6
118
131
112
40
132
102
106
104
110
134
108
112
131
142
96
130
26
82
90
100
80
88
131
36
44
48
133
52
142
32
34

RECLINING CHAIR

BACKGROUND OF THE INVENTION

Various forms of reclining chairs and sofas have been heretofore designed. Some of these previously known structures are disclosed in U.S. Pat. Nos. 1,266,691, 1,903,918, 2,377,649, 2,602,169, 2,985,893, 3,317,929 and 3,435,468.

However, some of these previously known devices include structure enabling only one reclined position of the reclining chair or couch construction to be achieved. Other previously known constructions include detent structures whereby two different inclined positions may be achieved. Still further, some previously known structures are not capable of being transformed from upright chair or couch defining positions to reclining positions without the user of the chair or couch having to vacate the construction in order to shift the chair or couch construction between different positions thereof.

BRIEF DESCRIPTION OF THE INVENTION

The reclining chair construction of the instant invention may be readily modified so as to define a two or three person reclining couch or sofa merely by widening the main frame as well as the seat, seat back and leg rest portions thereof. Further, the reclining chair construction of the instant invention includes structure whereby an infinite number of reclining positions may be achieved within the range of adjustment of the chair construction and an adjustment in the reclining position of the chair construction may be accomplished by a person seated in the chair with little effort.

It is a further important aspect of this invention that the back rest portion of the construction projects only slightly further rearward of the frame of the construction when the back rest portion is shifted from the upright chair defining position to the fully reclined position thereof and it is also to be noted that substantially all of the back rest defining portion which projects above the arm rests of the seat defining portion may be readily upwardly displaced for disengagement from the remaining portions of the chair construction and placed in horizontal position over the seat portion of the chair construction between the arm rests thereof for compact storage.

The main object of this invention is to provide a reclining chair constructed in a manner whereby an infinite number of reclined positions thereof may be achieved within the limits of adjustment of the chair construction.

Another important object of this invention is to provide a reclining chair constructed in a manner enabling the upright back rest portion thereof to be readily disengaged from the remainder of the chair and received in horizontal position over the seat portion of the chair between the arm rests thereof for compact storage.

A further object of this invention is to provide a reclining chair construction with its back rest, seat and leg rest portions shiftable to substantially horizontally aligned fully reclined positions.

Another important object of this invention, in accordance with the immediately preceding objects, is to provide a reclining chair construction whose back rest portion projects only slightly further rearward of the main frame of the chair when the back rest portion is in the fully reclined position.

A final object of this invention to be specifically enumerated herein is to provide a reclining chair construction, in accordance with the preceding objects, and which will conform to conventional forms to manufacture, be of simple construction and easy to use, so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 5, 6:
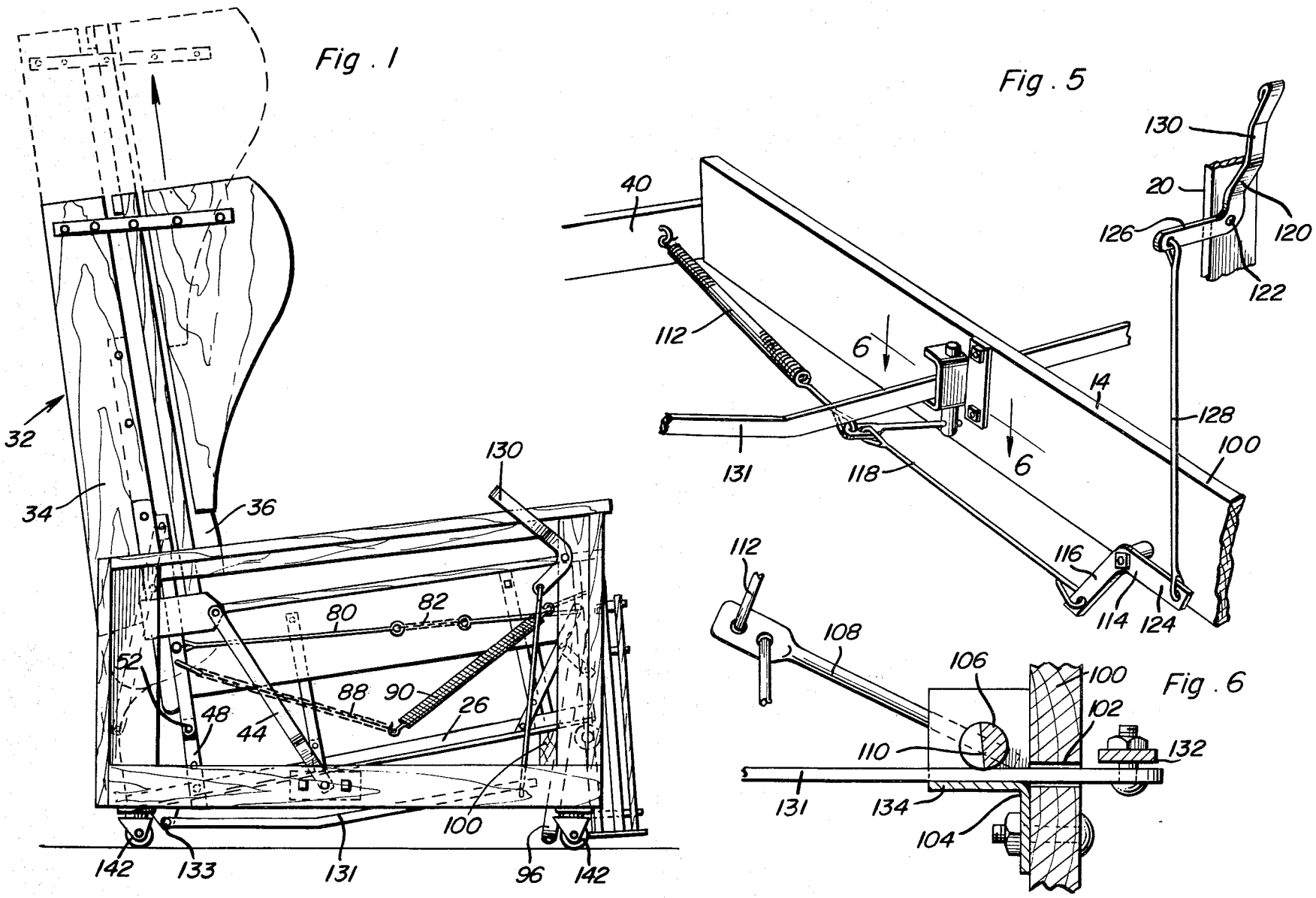
FIG. 1 is a side elevational skeltonized view of the chair construction with the back rest portion thereof illustrated in an upright chair defining position in phantom lines and in an upwardly displaced position in phantom lines fully disengaged from the remainder of the reclining chair.
FIG. 5 is a fragmentary perspective view of those components of the chair operative to maintain the chair in adjusted position.
FIG. 6 is an enlarged fragmentary horizontal sectional view taken substantially upon the plane indicated by the section line 6—6 of FIG. 5.
Figure 4:
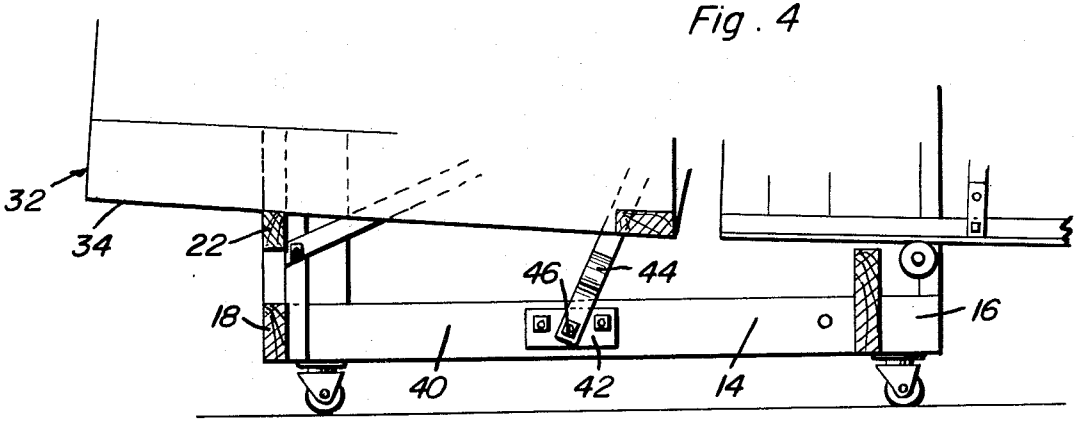
FIG. 4 is a fragmentary longitudinal vertical sectional view illustrating portions of the reclining chair assembly by which the back rest and seat portions thereof are supported from the frame when in the fully reclined positions.

Referring now more specifically to the drawings, the numeral 10 generally designates the reclining chair construction of the instant invention. The chair construction 10 includes a main frame referred to in general by the reference numeral 12 consisting of a rectangular lower frame section 14 having front and rear portions 16 and 18. The frame 12 further includes upstanding front to rear extending opposite side arm rest portions 20 and a horizontal brace 22 extending between lower rear portions of the arm rest portions 20.

The chair 10 includes a first seat section referred to in general by the reference numeral 24 consisting of a seat frame 26 having opposite side members 28 and a seat cushion 30 supported from the seat frame 26.

The seat construction 10 further includes a second back rest section referred to in general by the reference numeral 32 consisting of a back rest frame 34 and a back rest cushion 36 supported from the frame 34. Additionally, the seat construction or reclining chair 10 includes a third leg rest section referred to in general by the reference numeral 38.

The lower frame section includes opposite side longitudinal members 40 from whose mid-portions mounting brackets 42 are supported and the lower ends of a first pair of upstanding supportive links 44 are pivotally supported from the mounting brackets 42, as at 46. The rear ends of the opposite side members include upstanding mounting brackets 48 to which the lower ends of opposite side brackets 50 are pivotally supported as at 52, the opposite side brackets 50 comprising a lower support portion of the second back rest section 32. The brackets 50 include portions 54 thereof which define vertical through sockets or sleeves and the back rest section includes an upper back rest defining portion including the frame 34 and the cushion 36, the frame 34 including depending opposite side shank portions 56 removably telescoped downwardly through the sockets 54 as well as opposite side abutment members 58 abuttingly engageable with the brackets 50 to limit downward displacement of the shank portions 56 through the sockets 54.

A pair of supportive translation links 60 have one pair of corresponding ends thereof pivotally supported from rear lower portions of the arm rest portions 20, as at 62, and the other pair of ends thereof pivotally supported from opposite side portions of the frame 34, as at 64.

The leg rest section 38 includes a frame and also a seat cushion (not shown) for disposition over the frame 66, and opposite side upper portions of the frame 66 are pivotally supported from upper forward opposite side portions of the seat frame 26, as at 68. Further, a pair of bell cranks 70 have their mid-portions pivotally supported from opposite side upper forward portions of the frame 26, at at 72, and one pair of corresponding ends of a pair of actuating links 74 are pivotally anchored to one pair of corresponding ends of the bell cranks 70, as at 76. The other pair of corresponding ends of the links 74 are pivotally attached to the frame 66, as at 78, and a pair of tension members 80 includin flexible intermediate sections 82 thereof have one pair of corresponding ends pivotally attached to the other ends of the bell cranks 70, as at 84. The other pair of corresponding end of the tension members 80 are attached, as at 86, to the brackets 50 above the pivot connecion 52 thereof with the brackets 48. Also, a pair of flexible tension members 88 including expandable spring sections 90 thereof have one pair of corresponding ends therof secured as at 92 to upper portions of the brackets 50 and the other pair of corresponding ends thereof anchored to upper forward portions of the seat frame 26, as at 94.

The forward portion of the seat frame 26 includes a pair of rigid opposite side depending legs 96 and opposite side lower forward portions of the arm rest portions 20 include rollers 98 upon which the under surface portions of the opposite side lower longitudinal members 28 of the seat frame 26 are rollingly disposed.

With reference now more specifically to FIGS. 2, 3, 5 and 6 of the drawings, it may be seen that the forward transverse member 100 of the lower frame section 14 has a central vertical slot 102 formed therethrough. A mounting bracket 104 is secured to the inner surface of the transverse member 100 and oscilllatably supports an upstanding cylindrical shaft 106 including a lower rearwardly projecting crank arm portion 108 and a notched intermediate portion 110 at an elevation registered with the elevation of the slot 102. An expansion spring 112 is connected between the free end of the crank arm portion 108 and the left side longitudinal member 40 of the lower frame section 14, and a bell crank 114 is oscillatably supported from the right hand portion of the transverse member 100 and includes a first arm portion 116 operatively connected to the crank arm portion 108 by means of a connecting link 118. A further bell crank 120 is pivotally supported from a forward upper portion of the right hand arm rest portion 20, as at 122, and the second arm 124 of the bell crank 114 is connected to a first arm 126 of the bell crank 120 by means of a connecting link 128, the second arm 130 of the bell crank 120 defining a hand lever. Accordingly, the arm 130 or hand lever may be actuated to swing the crank arm portion 108 in a counterclockwise direction against the biasing action of the spring 112.

An elongated front to rear extending adjustment bar 131 has its rear end pivotally attached to the seat frame 26, as at 133, and its forward end slidably received through the slot 102 and provided with an abutment 132 to limit rearward sliding movement of the bar 131 through the slot 102. The bracket 104 includes an abutment flange 134 along one side of which the bar 131 is slidingly engaged and the shaft 106 is disposed immediately on the other side of the bar 131 from the abutment flange 134. When the shaft 106 is turned to the position thereof illustrated in FIG. 6 under the biasing action of the spring 112, the bar 131 is tightly clamped between the shaft 106 and the abutment flange 134. However, when the arm or lever 130 is pulled rearwardly the rear free end of the crank arm portion 108 is swung in a counterclockwise direction so as to more fully register the notched portion 110 of the shaft 106 with the side of the bar 131 remote from the flange 134. In this manner, the bar 131 is freed for sliding movement relative to the flange 134 and thereby enables adjustment of the reclined position of the chair construction 10. Of course, upon releasing manual pressure from the arm or lever 130, the expansion spring 112 will return the crank arm portion 108 to the position thereof illustrated in FIG. 6 in order to tightly clamp the bar 131 between the shaft 106 and the abutment flange 134 and thereby lock the chair construction 10 against shifting from the adjusted position thereof.

With attention now invited more specifically to FIGS. 1, 2, 3 and 4 of the drawings, it may be seen that the frame 34 of the second back rest section 32 rests upon the brace 22 when the back rest section is in the fully reclined position. Additionally, the support links 44 are only slightly forwardly inclined when the back rest section 32 is in the fully reclined position and accordingly, the back rest section 32 may support a considerable amount of weight. Additionally, the links 44 and 60 are inclined most advantageously to support downward weight being applied to the first seat section 24 and the second back rest section 32 when the sections are in the intermediate reclining position thereof illustrated in FIG. 2 and the links 44 and 60 are also most advantageously inclined to support downward weight applied to the rear portion of the first seat section 24 when the latter is fully registered over the lower frame section 14.

Figure 2:
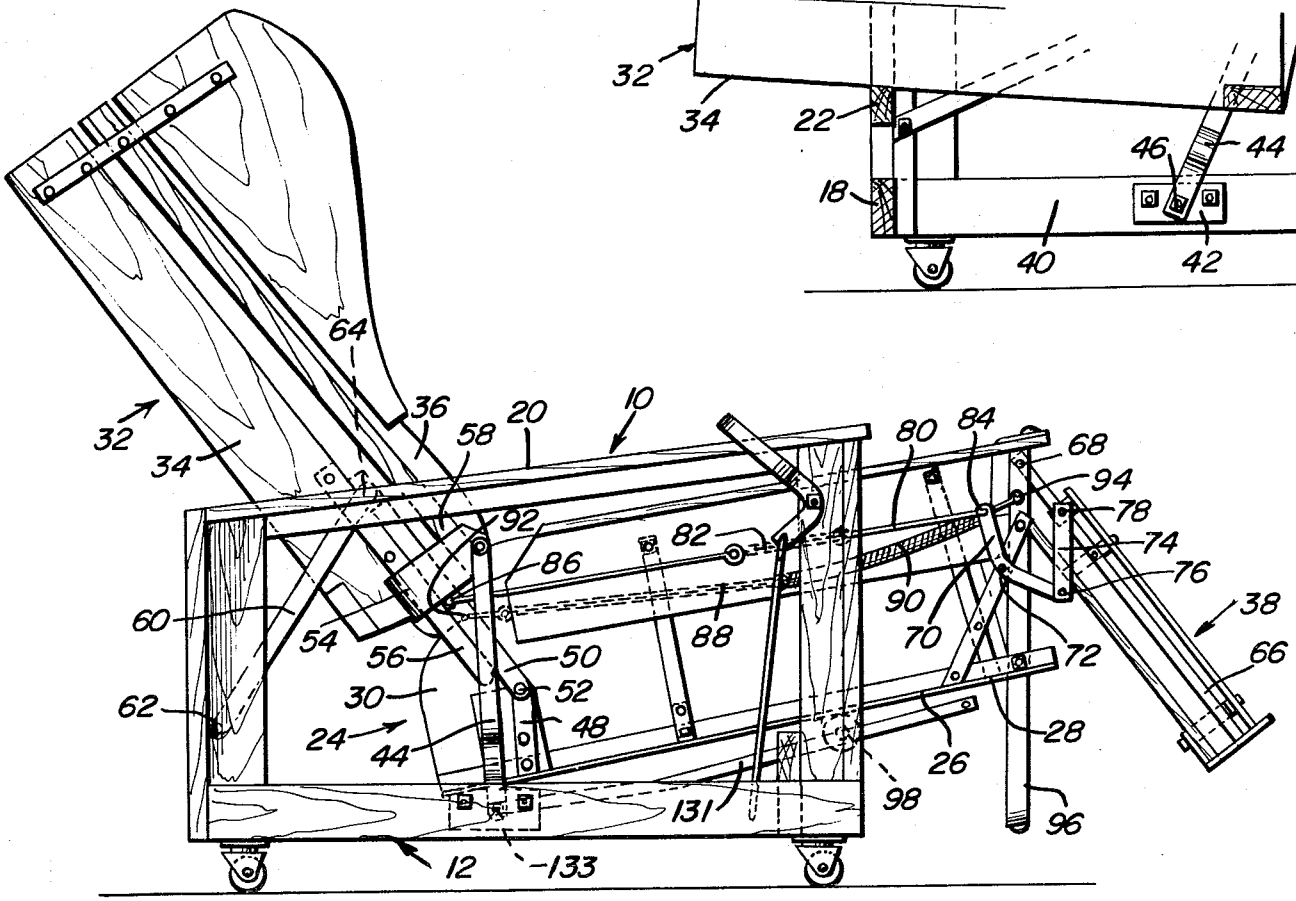
FIG. 2 is a side elevational view similar to FIG. 1 but with the back rest, seat and leg rest portions of the chair in semi-reclined position.
Figure 3:
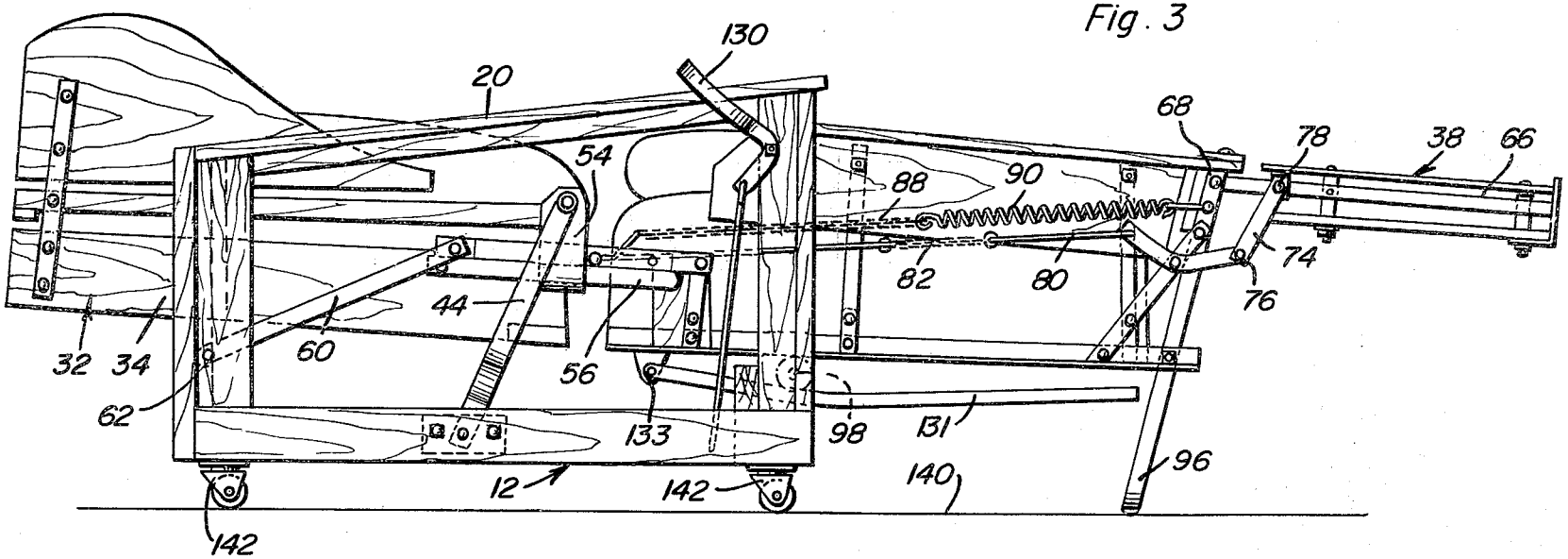
FIG. 3 is still another side elevational view of the chair construction with the back rest, seat and leg rest portions in fully reclined positions.

When the first seat section 24 is in the partially reclined position illustrated in FIG. 2, the rear portion of the section 24 is supported, by means of the pivotal connection between the braces 48 and 50 and the links 44 and the rear portion of the first seat section 24 is supported by the engagement of the under surface portions of the longitudinal members 28 of the seat frame 26 on the rollers 98. Also, it will be noted that while the legs 96 are in a raised inoperative position when the seat section 24 is in both the positions thereof illustrated in FIGS. 1 and 2 of the drawings, the lower ends of the legs 96 are disposed in engagement with the surface 140 upon which the caster wheels 142 of the main frame 12 rest when the sections 24, 32 and 38 are in their fully reclined positions.

Figure 7:
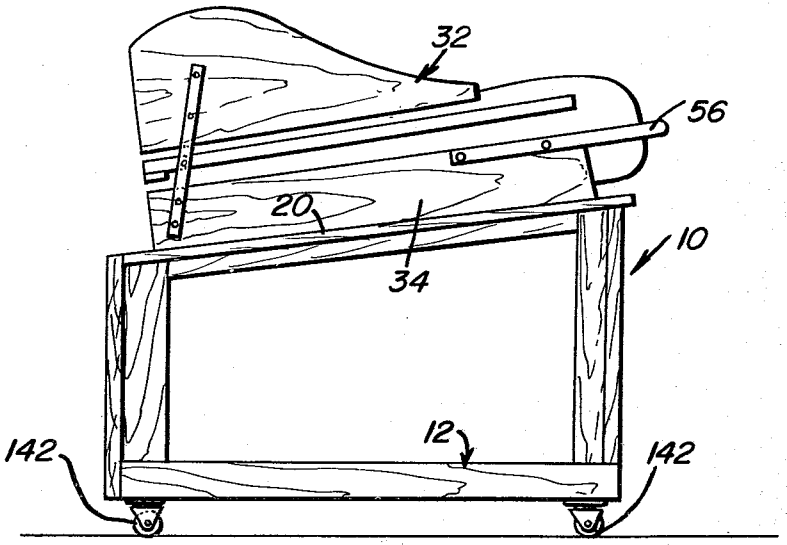
FIG. 7 is a side elevational view of the chair construction with the back rest portion thereof fully disengaged from the remainder of the chair construction and resting upon the seat portion thereof between the arm rests of the chair construction in a compact position for storage and/or shipping purposes.

From FIG. 7 of the drawings, it may be seen that the frame 34 and the cushion 36 defining the seat back portion are upwardly displaced so as to disengage the seat back portion from the remainder of the chair construction 10, the seat back portion may be horizontally disposed and rested upon the first seat section 24 between the arm rest portions 20. In this condition, the seat or chair construction 10 may be enclosed within a considerably smaller carton for shipping or storage.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A seat construction including a main frame having front and rear portions, a first seat section, first means supporting said first section from said frame for shifting between a first rear position vertically registered with said main frame and a second forwardly displaced position with a majority of said first section projecting forwardly of said main frame, a second back rest section, second means pivotally supporting said second back rest portion from said frame and said first section and establishing a supportive link connection with said frame for automatic movement of said second section from a first raised upstanding position at the rear portion of said frame to a lowered second horizontal position disposed immediately to the rear of and in horizontal alignment with said first section and with a major portion of said second section disposed forward of the rear portion of said frame movement of said first section to second second position thereof, and a third leg rest section, third means pivotally supporting said third section from said first section for automatice movement from a first position depending downwardly from the forward portion of said first section and a second horizontal position projecting forwardly from said first section upon movement of said first and second sections from the first positions thereof to said second positions thereof, said second means including swingable suspension link means operative to suspend substantially the entire load represented by the rear portion of said first section therefrom during movement of said first section between its first and second positions.

2. The combination of claim 1 wherein said frame and first section include coacting means guidingly and supportingly engaging said first section from the forward portion of said frame during movement of said first section between its first and second positions.

3. A seat construction including a main frame having front and rear portions, a first seat section, first means supporting said first section from said frame for shifting between a first rear position vertically registered with said main frame and a second forwardly displaced position with a majority of said first section projecting forwardly of said main frame, a second back rest section, second means pivotally supporting said second back rest portion from said frame and said first section and establishing a supportive link connection with said frame for automatic movement of said second section from a first raised upstanding position at the rear portion of said frame to a lowered second horizontal position disposed immediately to the rear of and in horizontal alignment with said first section and with a major portion of said second section disposed forward of the rear portion of said frame upon movement of said first section to second second position thereof, and a third leg rest section, third means pivotally supporting said third section from said first section for automatic movement from a first position depending downwardly from the forward portion of said first section and a second horizontal position projecting forwardly from said first section upon movement of said first and second sections from the first positions thereof to said second positions thereof, said second section including a lower support portion and an upper back rest defining portion disposed in an upstanding position when said second section is disposed in said first position thereof, said back rest defining portion and support portion including removably telescopingly engaged coacting means supporting said back rest portion from said support portion for complete disengagement of the former from the latter upon upward displacement of said back rest portion a predetermined distance relative to said support portion, along a predetermined path of movement generally paralleling the upstanding position of said upper back rest portion.

4. The combination of claim 3 wherein said first portion includes upstanding front to rear extending opposite side arm rests, said back rest portion, upon disengagement from said support portion, being receivable, horizontally, between said arm rests upon said first section.

5. A seat construction including a main frame having front and rear portions, a first seat section, first means supporting said first section frame for shifting between a rear position vertically registered with said main frame and a second forwardly displaced position with a majority of said first section projecting forwardly of said main frame, a second back rest section, second means pivotally supporting said back rest portion from said first section and establishing a supportive link connection with said frame for automatic movement of said second section from a first raised upstanding position at the rear portion of said frame to a lowered second horizontal position disposed immediately to the rear of and in horizontal alignment with said first section and with a major portion of said second section disposed forward of the rear portion of said frame upon movement of said first section to said second position thereof, and a third leg rest section, third means pivotally supporting said third section from said first section for automatic movement from a first position depending downwardly from the forward portion of said first section and a second horizontal position projecting forwardly from said first section upon movement of said first and second sections from the first positions thereof to said second positions thereof, said second means including swingable suspension link means operative to suspend substantially the entire load represented by the rear portion of said first section therefrom during movement of said first section between its first and second positions, said frame and first section including coacting means guidingly and supportingly engaging said first section from the forward portion of said frame during movement of said first section between its first and second positions, said coacting means including means operative to raise and lower the forward portion of said first section upon its shifting back and forth from its second position to its first position and back to its second position, the forward portion of said first seat section including depending leg means for support from a support surface upon movement of said first section to its second position, said legs being retracted rearward of the forward portion of said frame when said first seat section is in its first position.

6. A seat construction including a main frame having front and rear portions, a first seat section overlying and supported from said frame, and a second upstanding back rest section supported from said frame and projecting upwardly from the rear portion of said main frame, said frame including opposite side front to rear extending arm rest portions projecting upwardly above said first seat section, said second back rest portion and said frame including telescopingly engaged structures supporting said back rest section from said frame for total removal therefrom upon upward displacement of said back rest section relative to said frame a predetermined amount above a lower limit position of said back rest section along a predetermined path of movement generally paralleling the upstanding position of said upper back rest position, said back rest section, after its total removal from said frame being receivable, in horizontal position, between said arm rest portions for support from said seat section.

7. A seat construction including a main frame having front and rear portions, a first seat section, first means supporting said first section from said frame for shifting between a first rear position vertically registered with said main frame and a second forwardly displaced position with a majority of said first section projecting forwardly of said main frame, a second back rest section, second means pivotally supporting said second back rest portion from said frame and said first section and establishing a supportive link connection with said frame for automatic movement of said second section from a first raised upstanding position at the rear portion of said frame to a lowered second horizontal position disposed immediately to the rear of and in horizontal alignment with said first section and with a major portion of said second section disposed forward of the rear portion of said frame upon movement of said first section to second second position thereof, and a third leg rest section, third means pivotally supporting said third section from said first section for automatice movement from a first position depending downwardly from the forward portion of said first section and a second horizontal position projecting forwardly from said first section upon movement of said first and second sections from the first positions thereof to said second positions thereof, an elongated front-to-rear extending bar pivotally supported at its rear end from a lower rear portion of said first seat section for oscillation about a horizontal transverse axis, said bar extending forwardly from said rear portion of said first seat section beneath the latter, guide means carried by a forward portion of said main frame and slidably and guidingly engaging said bar for lengthwise shifting of the latter relative to said guide means, said guide means including selectively operable clamp means for releasably clampingly engaging said bar in shifted position against shifting relative to said guide means, and actuator means for said clamp means shiftably supported from one side portion of said main frame and operably connected to said clamp means for selective actuation thereof, said actuator means being adapted to be actuated by one hand of a person seated upon said first seat section.

* * * * *